US007413422B2

(12) United States Patent
Ito

(10) Patent No.: US 7,413,422 B2
(45) Date of Patent: Aug. 19, 2008

(54) COMPRESSOR INCLUDING PRESSURE RELIEF MECHANISM

(75) Inventor: Kiyofumi Ito, Isesaki (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 118 days.

(21) Appl. No.: 11/100,479

(22) Filed: Apr. 7, 2005

(65) Prior Publication Data

US 2005/0226756 A1 Oct. 13, 2005

(30) Foreign Application Priority Data

Apr. 13, 2004 (JP) ..... 2004-118225

(51) Int. Cl.
*F04C 18/00* (2006.01)

(52) U.S. Cl. ..... 418/55.6; 418/55.1; 418/97

(58) Field of Classification Search ..... 418/180, 418/55.1, 89, 91, 55.6, 97
See application file for complete search history.

(56) References Cited

U.S. PATENT DOCUMENTS

| | | | | |
|---|---|---|---|---|
| 1,405,259 | A | 1/1922 | Beach | |
| 1,854,692 | A | 4/1932 | Cooper | |
| 3,317,123 | A | 5/1967 | Funke | |
| 3,684,412 | A | 8/1972 | Harlin et al. | |
| 3,850,009 | A | 11/1974 | Villadsen | |
| 4,332,535 | A | 6/1982 | Terauchi et al. | |
| 4,360,321 | A * | 11/1982 | Copp et al. | 417/269 |
| 4,470,778 | A | 9/1984 | Mabe | |
| 4,547,138 | A | 10/1985 | Mabe et al. | |
| 4,666,381 | A | 5/1987 | Butterworth | |
| 4,892,469 | A | 1/1990 | McCullough et al. | |
| 4,958,991 | A | 9/1990 | Kikuchi | |
| 5,421,708 | A * | 6/1995 | Utter et al. | 418/55.6 |
| 5,556,265 | A * | 9/1996 | Michiyuki et al. | 417/312 |
| 5,733,107 | A | 3/1998 | Ikeda et al. | |
| 5,800,133 | A * | 9/1998 | Ikeda et al. | 417/312 |
| 6,017,205 | A * | 1/2000 | Weatherston et al. | 418/55.6 |
| 6,152,713 | A * | 11/2000 | Hisanaga et al. | 418/55.6 |
| 6,227,831 | B1 | 5/2001 | Osima et al. | |
| 6,322,339 | B1 * | 11/2001 | Mitsunaga et al. | 418/55.2 |
| 6,454,538 | B1 * | 9/2002 | Witham et al. | 417/32 |
| 6,485,535 | B1 | 11/2002 | Linnersten et al. | |
| 6,511,530 | B2 | 1/2003 | Iwanami et al. | |
| 7,101,160 | B2 | 9/2006 | Gennami et al. | |
| 2001/0018025 | A1 * | 8/2001 | Sakai et al. | 417/374 |
| 2002/0134101 | A1 * | 9/2002 | Gennami et al. | 62/469 |

(Continued)

FOREIGN PATENT DOCUMENTS

DE 2822780 A1 7/1978

(Continued)

*Primary Examiner*—Thomas Denion
*Assistant Examiner*—Mary A Davis
(74) *Attorney, Agent, or Firm*—Baker Botts L.L.P.

(57) ABSTRACT

A scroll compressor is provided with a housing having a discharge chamber to which a high-pressure refrigerant is discharged from a scroll unit, a discharge path connecting the discharge chamber and an outlet port 78 of the housing, a separating device arranged in the discharge path and separating a part of the lubricating oil from the refrigerant, and a relief valve arranged in a downstream side of the separating device in the discharge path. When a pressure within the discharge path exceeds a relief pressure, the relief valve is opened so as to eject the refrigerant to an outer side of the compressor from the discharging path.

3 Claims, 3 Drawing Sheets

U.S. PATENT DOCUMENTS

| | | | |
|---|---|---|---|
| 2005/0129536 | A1 | 6/2005 | Ohtake |
| 2005/0129556 | A1 | 6/2005 | Ito |
| 2005/0265878 | A1 | 12/2005 | Ishida |
| 2005/0271534 | A1 | 12/2005 | Yokoyama |
| 2006/0065012 | A1 | 3/2006 | Kudo |

FOREIGN PATENT DOCUMENTS

| | | | | |
|---|---|---|---|---|
| JP | 61-205386 | A | | 9/1986 |
| JP | 63-016190 | A | | 1/1988 |
| JP | 63-106393 | A | | 11/1988 |
| JP | 07-151083 | A | | 6/1995 |
| JP | 11082352 | | | 3/1999 |
| JP | 2000-170681 | A | | 6/2000 |
| JP | 2003184523 | A | * | 7/2003 |
| JP | 2003-129975 | A | | 5/2005 |

* cited by examiner

COMPRESSOR INCLUDING PRESSURE RELIEF MECHANISM

This Nonprovisional application claims priority under 35 U.S.C. 119(a) on Patent Application No. 2004-118225 filed in Japan on Apr. 13, 2004, the entire contents of which are hereby incorporated by reference.

BACKGROUND OF THE INVENTION

1. Field of the Invention

The present invention relates to a compressor, and more particularly to a compressor arranged in a refrigerating circuit for an air conditioning system of a vehicle.

2. Description of the Related Art

This kind of compressor is used for compressing a refrigerant serving as a working fluid. In general, the refrigerant contains a mist-like lubricating oil, and the lubricating oil serves for not only lubricating sliding surfaces in the compressor, bearings and the like, but also sealing sliding surfaces in the compressor. However, in the case that the lubricating oil contained in the refrigerant is more, the lubricating oil causes to lower refrigerating performance of the refrigerating circuit.

A compressor disclosed in Japanese Unexamined Patent Publication No. 11-82352, therefore, includes a discharge chamber to which a compressed high-pressure refrigerant is discharged, an outlet port for discharging the refrigerant to a circulating path outside the compressor from the discharge chamber, and a separating device for separating the mist-like lubricating oil from the refrigerant, and the separating device is arranged in a delivery path extending to the outlet port from the discharge chamber. In more detail, the separating device includes a separating chamber forming a part of the delivery path, and the separating chamber receives the high-pressure refrigerant from the discharge chamber. The lubricating oil in the refrigerant is partly separated from the refrigerant in the separating chamber on the basis of centrifugal separating effect. The separated lubricating oil is stored in an oil storage chamber, and the oil storage chamber is arranged in a lower side of the separating chamber.

On the other hand, the compressor further includes an intake chamber for supplying the refrigerant to a compression chamber thereof, and the lubricating oil in the oil storage chamber is returned into the intake chamber, and is mixed into the refrigerant in the intake chamber as oil mist.

When the compressor has the separating device therein, an amount of the lubricating oil in the refrigerant discharged to the circulating path from the compressor is small, and it is possible to avoid the refrigerating performance of the refrigerating circuit from being lowered.

As mentioned above, since it is necessary that the separating chamber of the separating device and the storage chamber are secured in the compressor together with the discharge chamber, it is unavoidable that a volumetric capacity of the discharge chamber becomes necessarily small in the case that size of the compressor is fixed.

Further, in order to improve the separating performance of the lubricating oil, it is necessary to accelerate flow speed of the refrigerant introduced into the separating chamber from the discharge chamber. Therefore, the cross sectional area of a jet hole which connects the discharge chamber and the separating chamber has a small.

Further, in order to well lubricate the sliding surfaces and the bearings in the compressor, it is preferable to increase an amount of the lubricating oil returned to the intake chamber. To this end, a lot of lubricating oil is stored in the oil storage chamber.

For the reasons mentioned above, in the case that a load of the compressor, that is, a discharge amount of the high-pressure refrigerant into the discharge chamber is increased, pressure in the discharge chamber is exponentially increased, thereby instantaneously exceeding an allowable maximum discharge pressure of the compressor which causes compression of the lubricating oil in the refrigerant.

On the other hand, the compressor is provided with a relief valve in the discharge chamber, and the relief valve can limit discharge pressure in the discharge chamber to the allowable maximum discharge pressure or less.

However, when an impact pressure such as to instantaneously exceed the allowable maximum discharge pressure is frequently generated in the discharge chamber, the relief valve is erroneously operated so as to be opened every time when the impact pressure is generated, so that the refrigerant including a lot of lubricating oil is ejected to an outer side of the compressor, that is, to an outer side of the circulating path from the discharge chamber. Accordingly, since the refrigerant and the lubricating oil in the circulating path are both reduced, the refrigerating performance of the refrigerating circuit is significantly lowered, and the lubrication in the compressor runs short, whereby malfunction of the compressor is caused.

In order to avoid an improper operation of the relief valve, there can be considered that the relief valve is arranged in the oil storage chamber. However, since a lot of lubricating oil is stored in the oil storage chamber and space above a liquid surface level of the lubricating oil is reduced, the impact pressure generated in the discharge pressure is directly propagated in the space, and the relief valve is improperly operated. In this case, since the lubricating oil is ejected to an outer side of the circulating path from the oil lubricating chamber together with the refrigerant, a lot of lubricating oil is lost from the circulating path.

SUMMARY OF THE INVENTION

An object of the present invention is to provide a compressor which prevents an improper operation of a relief valve and prevents working fluid and lubricating oil therein from being undesirably lost.

In order to achieve the object mentioned above, a compressor according to the present invention comprises:

a housing having an intake chamber and a discharge chamber defined therein, an inlet port and an outlet port provided in an outer surface of the housing, and a discharge path connecting the discharge chamber and the outlet port;

a compressing unit provided in the housing, the compressing unit having a compression chamber for compressing working fluid supplied to the intake chamber from the inlet port and discharging the working fluid compressed to the discharge chamber, the working fluid including lubricating oil;

a separating device arranged in the discharge path and separating a part of the lubricating oil in the working fluid from the working fluid; and a relief device for ejecting the working fluid in the discharge path to an outer side of the discharge path when a pressure in the discharge path exceeds a predetermined relief pressure at a downstream position of the separating device.

According to the compressor of the present invention mentioned above, the relief device is located in a downstream side of the separating device. When the impact pressure exceeding the relief pressure of the relief device is instantaneously generated in the discharge chamber, the impact pressure is therefore attenuated lower than the relief pressure before the impact pressure is propagated to the relief device. As a result, the improper operation of the relief device caused by the impact pressure can be effectively lowered.

Even if the relief device is improperly operated, the working fluid ejected to the outer side of the discharge path through the relief device has already undergone a separating process of the lubricating oil by the separating device, so that an amount of the lubricating oil is reduced in the ejected working fluid. Accordingly, in the case that the compressor according to the present invention is used in the refrigerating circuit, a lot of lubricating fluid is not lost from the refrigerating circuit.

On the other hand, the working fluid introduced to the discharge chamber from the intake chamber via the compression chamber contains the lubricating oil sufficiently, and the lubricating oil in the working fluid is effectively used for lubricating of the compressor and sealing of the compression chamber in the compressor.

The relief device can include a relief valve located in a downstream side of the discharge path. In this case, it is preferable that the relief valve is located near the outlet port. When the relief valve is located near the outlet port as mentioned above, it is possible to secure length of the discharge path from the discharge chamber to the relief valve long, and the impact pressure can be effectively attenuated.

Further, it is preferable that the relief valve is located in an upper portion of the housing. In this case, since the relief valve can be easily visible from the upper side of the compressor, it is possible to easily detect a trace of the lubricating oil ejected from the relief valve, that is, a loss of the lubricating oil and the working fluid caused by the improper operation of the relief valve.

The housing can further has an adapter pipe forming the outlet port and provided with the relief valve. In this case, it is possible to further extend the length of the discharge path from the discharge chamber to the relief valve.

The compressing unit includes a movable scroll and a stationary scroll defining the compression chamber therebetween, and the discharge chamber is formed between the stationary scroll and an end wall of the housing.

In this case, the separating device includes a separating chamber formed in the end wall of the housing so as to be in adjacent to the discharge chamber and forming an upstream portion of the discharge path, a separating tube arranged in the separating chamber, having a lower end open to in the separating chamber and an upper end connected to a downstream portion of the discharge path and causing the working fluid flowed into the separating chamber to swirl around the separating tube, whereby a part of the lubricating oil in the working fluid is separated from the working fluid in the separating chamber, an oil storage chamber formed between the stationary scroll and the end wall of the housing so that the oil storage chamber is located in a lower side of the separating chamber and collects the separated lubricating oil from the separating chamber, and a return passage returning the lubricating oil to the intake chamber from the oil storage chamber.

Further, the housing can have a bulge portion integrally protruding to the inner side of the discharge chamber from the end wall and extending in a vertical direction, and a cylinder bore formed in the bulge portion. In this case, the separating chamber is formed by a lower portion of the cylinder bore.

According to the separating device mentioned above, it is possible to secure the separating chamber without enlarging the housing.

The downstream portion of the discharge path can be formed in the end wall of the housing, and can include a connection hole extending to the outlet port from an upper portion of the cylinder bore, and it is preferable that the connection hole has an axis orthogonal to an axis of the cylinder bore. In this case, since the downstream portion of the discharge path is bent, the impact pressure propagated to the relief valve from the discharge chamber is further effectively attenuated.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirits and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
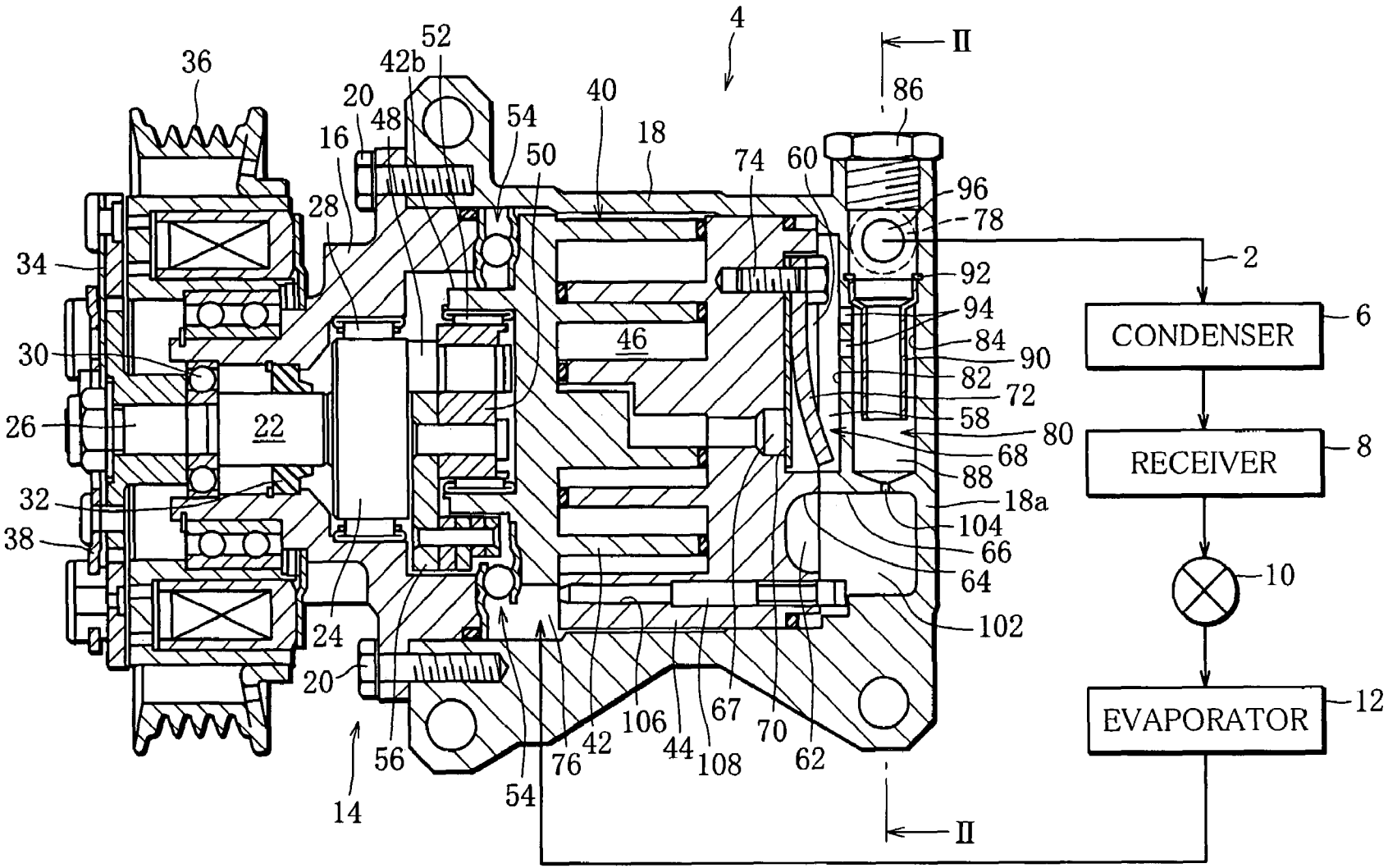
FIG. 1 is a vertical cross sectional view showing a scroll type compressor according to an embodiment.

According to FIG. 1, a refrigerating circuit for an air conditioning system of a vehicle is provided with a refrigerant circulating path 2, and a compressor 4, a condenser 6, a receiver 8, an expansion valve 10 and an evaporator 12 are sequentially arranged in the circulating path 2. The compressor 4 compresses a refrigerant and discharges a high-pressure refrigerant toward the condenser 6. As a result, the refrigerant discharged from the compressor 4 circulates the path 2, and the refrigerating circuit attains refrigerating performance.

The refrigerant includes mist-like lubricating oil, and the lubricating oil in the refrigerant serves for not only lubricating bearings and various sliding surfaces in the compressor, but also sealing compression chambers of the compressor. These bearings, sliding surfaces and compression chambers will be mentioned later.

The compressor 4 in FIG. 1 is shown as a so-called scroll compressor. The compressor 4 is provided with a housing 14, and the housing 14 has a front casing 16 and a rear casing 18. These casings 16 and 18 have flanges met each other, and these flanges are connected by a plurality of coupling bolts 20.

A drive shaft 22 is arranged in the front casing 16. The drive shaft 22 has a large-diameter end portion 24 located in a side of the rear casing 18, and a small-diameter shaft portion 26. The small-diameter shaft portion 26 extends to an opposite side to the rear casing 18 from the large-diameter end portion 24, and is protruded from the front casing 16. The large-diameter end portion 24 is rotatably supported to an inner surface of the front casing 16 via a needle bearing 28, and the small-diameter shaft portion 26 is rotatably supported to the inner surface of the front casing 16 via a ball bearing 30.

Further, a lip seal 32 is arranged in the front casing 16 so as to surround the small-diameter shaft portion 26. The lip seal 32 is located between the ball bearing 30 and the large-diameter end portion 24, and air tightly seals an inner side of the front casing 16.

A drive pulley 36 is coupled to an end of the small-diameter shaft portion 26 protruding from the front casing 16 via an electromagnetic clutch 34, and the drive pulley 36 is rotatably supported to an outer surface of the front casing 16 via a bearing 38. In this case, a part of the electromagnetic clutch 34 is housed in the drive pulley 36.

The drive pulley 36 receives a power from an engine of the vehicle via a drive belt (not shown), and is rotated in one direction. When the electromagnetic clutch 34 is turned on, the rotation of the drive pulley 36 is transmitted to the drive shaft 22 via the electromagnetic clutch 34, and the drive shaft 22 is rotated together with the drive pulley 36.

On the other hand, the rear casing 18 receives a scroll unit 40, and the scroll unit 40 includes a movable scroll 42 and a stationary scroll 44. These movable and stationary scrolls 42 and 44 have spiral walls engaging with each other. The spiral wall of the movable scroll 42 is in sliding contact with the spiral wall of the stationary scroll 44, and compression chambers 46 are defined between these spiral walls. When the movable scroll 42 is revolved, the compression chamber 46 moves toward a center from an outer periphery of the stationary scroll 44, and a volumetric capacity of the compression chamber 46 is reduced in accordance with the movement thereof.

In order to revolve the movable scroll 42, a crank pin 48 protrudes toward the movable scroll 42 from the large-diameter end portion 24 of the drive shaft 22, and an eccentric bush 50 is mounted on the crank pin 48. The eccentric bush 50 is rotatably supported to a boss 42*b* of the movable scroll 42 via a needle bearing 52. Accordingly, when the drive shaft 22 is rotated, the movable scroll 42 is revolved around the drive shaft 22, and a revolution radius of the movable scroll 42 is determined by a distance between axes of the drive shaft 22 and the crank pin 48.

Further, a ball type thrust bearing 54 is arranged between the movable scroll 42 and the front casing 16. The thrust bearing 54 includes a stationary ring, a movable ring and a plurality of balls sandwiched between annular race grooves of these rings. When the movable scroll 42 is revolved, each of the balls rolls along corresponding annular race grooves, whereby it is possible to prevent the movable scroll 42 from rotating on its own axis.

Further, a counter weight 56 with respect to the movable scroll 42 is attached to the eccentric bush 50, and the counter weight 56 makes the revolving rotation of the movable scroll 42 smooth.

The stationary scroll 44 is fixed to the rear casing 18 via a plurality of fixing bolts (not shown), and the rear casing 18 defines a discharge chamber 58 between an end wall 18*a* of the rear casing 18 and the stationary scroll 44 therein.

In more detail, recess portions 60 and 62 are formed in a rear surface of the stationary scroll 44, and these recess portions 60 and 62 are apart from each other in a vertical direction as viewed of FIG. 1 and are separated by a partition wall 64. On the other hand, a partition wall 66 protrudes from the end wall 18*a* of the rear casing 18, and the partition wall 66 abuts on the partition wall 64. These partition walls 64 and 66 form a discharge chamber 58 in the side of the recess portion 60.

The stationary scroll 44 has a discharge hole 67 in a center portion thereof, and the discharge hole 67 can communicate the compression chamber 46 and the discharge chamber 58 with each other. A discharge valve 68 is arranged in the discharge chamber 58, that is, the recess portion 60, and the discharge valve 68 opens and closes the discharge hole 67. The discharge valve 68 includes a valve lead 70, and a stopper plate 72 regulating an opening of the valve lead 70, and these valve lead 70 and stopper plate 72 are both attached to the stationary scroll 44 via an attaching screw 74.

On the other hand, an intake chamber 76 is secured between an outer peripheral wall of the rear casing 18 and the scroll unit 40, and the intake chamber 76 is connected to an inlet port (not shown) of the rear casing 18. The inlet port is formed in the outer peripheral wall of the rear casing 18, and is connected to the evaporator 12 via the circulating path 2.

Figure 2:
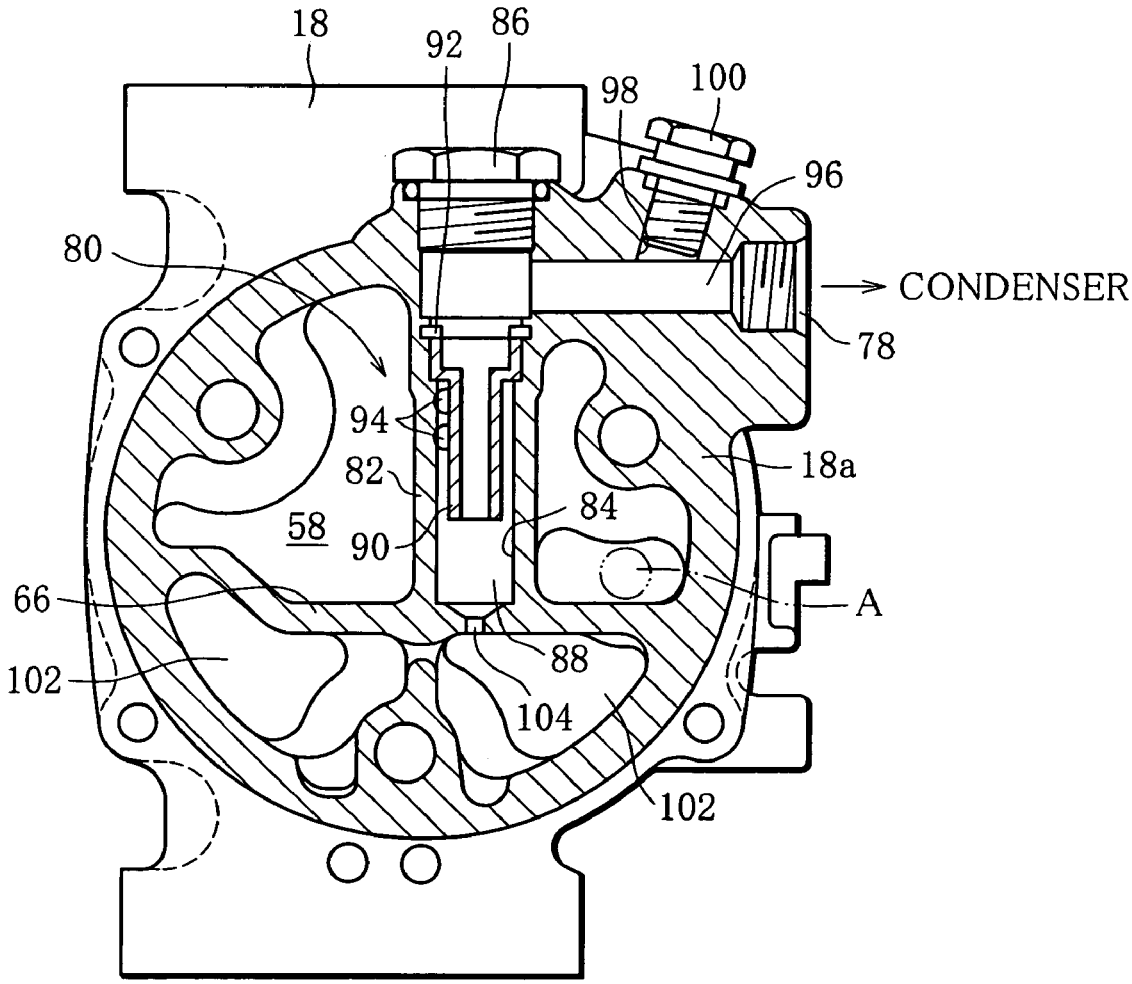
FIG. 2 is a cross sectional view along a line II-II in FIG. 1.

An outlet port 78 is formed in an upper portion of the end wall 18*a* in the rear casing 18 (refer to FIG. 2). The outlet port 78 is open toward a lateral side of the compressor 4, and is connected to the condenser 6 via the circulating path 2. On the other hand, the outlet port 78 is connected to the discharge chamber 58 through a discharge path.

A separating device 80 and a relief device are arranged in the discharge path, and a description will be in detail given below about these separating device 80 and relief device.

A bulge portion 82 is integrally formed in an inner surface of the end wall 18*a* of the rear casing 18. The bulge portion 82 protrudes to an inner side of the discharge chamber 58. The bulge portion 82 is formed in a columnar shape, and extends to a peripheral wall of the rear casing 18 from the partition wall 66 of the end wall 18*a*. A cylindrical bore 84 is formed in the bulge portion 82, and the cylindrical bore 84 is open to the outer peripheral wall of the rear casing 18. The cylindrical bore 84 extends to the partition wall 66 from the outer peripheral wall of the rear casing 18, and the opening end of the bore 84 is closed by a plug 86.

In FIG. 1, a lower portion of the cylindrical bore 84 is formed as a separating chamber 88, and a separating tube 90 is concentrically arranged in an upper portion of the separating chamber 88. The separating tube 90 has a large-diameter portion in an upper end thereof, and is fixed in the separating chamber 88 by the large-diameter portion being forcibly fit into the cylindrical bore 84. Further, a snap ring 92 is disposed in an upper end of the separating tube 90, and the snap ring 92 inhibits the separating tube 90 from coming off from the separating chamber 88.

The separating chamber 88 has a cylindrical space between a lower end of the separating tube 90 and the partition wall 66, and an annular space between an inner peripheral surface of the separating chamber 88 and a small-diameter portion of the separating tube 90. Further, two jet holes 94 are formed in the bulge portion 82. These jet holes 94 are apart from each other in the vertical direction as viewed of FIG. 1, and communicate the discharge chamber 58 with the annular space of the separating chamber 88. Axes of these jet holes 94 extend so as to be tangent with an outer peripheral surface of the separating tube 90.

On the other hand, a connecting hole 96 extends from an upper portion of the cylinder bore 84. As is apparent from FIG. 2, an axis of the connecting hole 96 is orthogonal to an axis of the cylinder bore 84, and connects the cylinder bore 84 and the outlet port 78 to each other. Accordingly, the separating chamber 88 is connected to the outlet port 78 via the separating tube 88, an upper portion of the cylinder bore 84 and the connecting hole 96.

As shown in FIG. 2, an attaching hole 98 is formed in the upper portion of the rear casing 18, and the attaching hole 98 is communicated with the connecting hole 96 at a position near the outlet port 78. A relief device, that is, a relief valve 100 is arranged in the attaching hole 98, and the relief valve 100 is screwed into the attaching hole 98 and has a head protruding to an upper side from the outer surface of the rear casing 18. When the pressure in the connecting hole 96 reaches a predetermined relief pressure or more, the relief valve 100 is opened so as to connect the connecting hole 96 to an external side of the compressor 4 that is, the circulating path 2.

In this case, a circle A shown by a two-dot chain line in FIG. 2 shows a position when the relief valve 100 is arranged in the discharge chamber 58.

On the other hand, an oil storage chamber 102 is formed in a lower side of the partition walls 64 and 66 in the rear casing 18, and the oil storage chamber 102 is communicated with the separating chamber 88 via an oil hole 104. The oil hole 104 is formed in the partition wall 66.

As shown in FIG. 1, a through hole 106 is formed in the stationary scroll 44, and the through hole 106 extends to the intake chamber 76 from a bottom portion of the oil storage chamber 102. A rod member 108 is inserted to the through hole 106, and the rod member 108 has an orifice passage and a strainer therein.

When the drive shaft 22 is rotated, the movable scroll 42 revolves without rotating on its own axis. The revolution motion of the movable scroll 42 executes a series of processes from suction of the refrigerant into the compression chamber 46 from the intake chamber 76, to discharge of the refrigerant via compression of the sucked refrigerant. As a result, when the pressure of the refrigerant in the compression chamber 46 overcomes a closing pressure of the discharge valve 68 and the discharge valve 68 is opened, the high-pressure refrigerant is discharged into the discharge chamber 58 from the compression chamber 46 through the discharge hole 67.

Since the mist-like lubricating oil is contained in the refrigerant, the lubricating oil in the refrigerant lubricates the bearings 28 and 52 in the front casing 16, the sliding surfaces and the like in the scroll unit 40, and serves for sealing the sliding surfaces, that is, the compression chambers 46.

The high-pressure refrigerant in the discharge chamber 58 flows into the separating chamber 88 of the separating device 80 from the jet holes 94. The inflow refrigerant moves downward in the separating chamber 88 while swirling around the outer peripheral surface of the separating tube 90. In this process, the lubricating oil in the refrigerant undergoes a centrifugal separating effect, whereby a part of the lubricating oil in the refrigerant is separated from the refrigerant, and the separated lubricating oil is received on the inner peripheral wall of the separating chamber 88. Thereafter, the refrigerant, which has undergone the separating effect, is introduced to the outlet port 78 from the lower end opening of the separating tube 90 through the separating tube 90 and the connecting hole 96, and is discharged toward the condenser 6 from the outlet port 78.

On the contrary, the lubricating oil separated from the refrigerant flows downwards along the inner peripheral wall of the separating chamber 88, is introduced to the oil storage chamber 102 via the oil hole 104, and is stored in the oil storage chamber 102. Since the oil storage chamber 102 is always communicated with the separating chamber 88, the pressure in the oil storage chamber 102 is sufficiently higher than the pressure in the intake chamber 76. Accordingly, a pressure difference between the oil storage chamber 102 and the intake chamber 76 injects the lubricating oil in the oil storage chamber 102 into the intake chamber 76 from a leading end of the rod member 108 through the strainer and the orifice passage in the rod member 108 mentioned above. At this time, the lubricating oil is atomized and is mixed into the refrigerant in the intake chamber 76.

Since the refrigerant discharged from the compressor 4 has already undergone the separating effect of the lubricating oil, a small amount of lubricating oil exists in the refrigerant flowing through the circulating path 2 except the compressor 4. Accordingly, the refrigerating circuit can sufficiently attain a requested refrigerating performance.

On the other hand, since the separated lubricating oil is returned to the intake chamber 76 from the oil storage chamber 102, the refrigerant in the front casing 16 and the refrigerant passing through the scroll unit 40 include a lot of lubricating oil, and it is possible to securely ensure the lubrication and the seal required in the compressor 4.

When the load of the compressor 4 is increased, and a impact pressure causing the compression of the lubricating oil is instantaneously generated in the discharge chamber 58, the impact pressure is attenuated in the process until the impact pressure is propagated to the relief valve 100 via the separating chamber 88 and the connecting hole 96. Accordingly, it is possible to largely reduce an improper operation of the relief valve 100 caused by the instantaneous generation of the impact pressure.

Even if the relief valve 100 is improperly operated, and the refrigerant is ejected to the outer side of the circulating path 2 from the relief valve 100 of the compressor 4, the amount of the lubricating oil lost from the refrigerating circuit is small because the ejected refrigerant has already undergone the lubricating oil separating effect.

Further, in the case that the compressor 4 is arranged in the engine room of the vehicle, there are various devices including the engine in the periphery of the compressor 4. However, since the relief valve 100 is arranged in the upper portion of the compressor 4, the relief valve 100 can be easily visible regardless of the another devices. Accordingly, when the refrigerant is ejected due to the improper operation of the relief valve 100, it is possible to estimate losses of the refrigerant and the lubricating oil from the refrigerating circuit by a trace of the lubricating oil in the periphery of the relief valve 100, so that it is possible to easily maintain the refrigerating circuit.

The present invention is not limited to the embodiment mentioned above, but can be variously modified.

Figure 3:
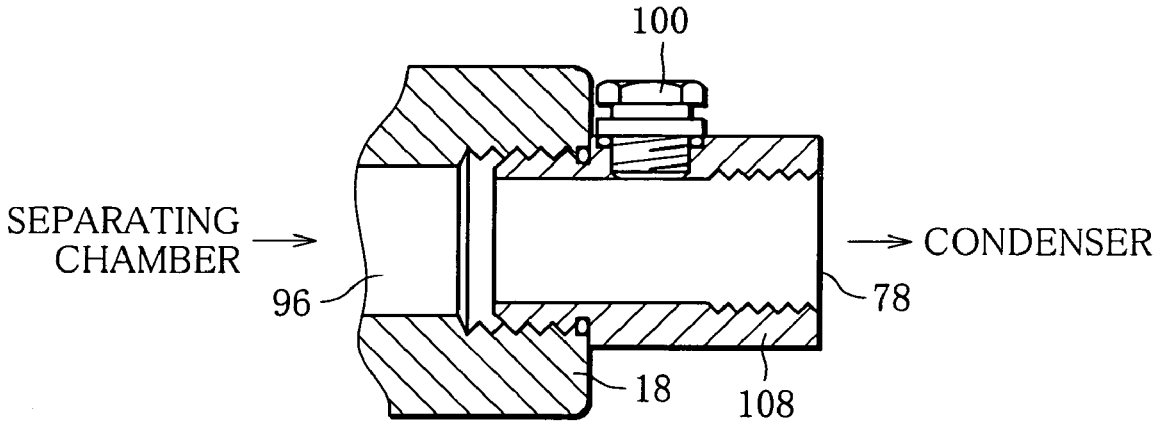
FIG. 3 is a view showing a part of a compressor according to a modified embodiment.

FIG. 3 shows a relief valve device in accordance with a modified embodiment.

The relief valve device includes an adapter pipe 108 interposed between a terminal end of the connecting hole 96 and the circulating path 2, and a relief valve 100 screwed into an outer peripheral surface of this adapter pipe 108. In this case, the adapter pipe 108 forms the outlet port 78.

The relief device in FIG. 3 can be easily attached to the existing compressor, and the discharge path extending to the discharge chamber 58 from the relief valve 100 is further extended, whereby the improper operation of the relief valve 100 can be further reduced.

It goes without saying that the separating device according to the present invention is not limited to the scroll compressor, but can be applied to a reciprocating piston type compressor in the same manner.

What is claimed is:

1. A compressor comprising:

a housing having an intake chamber and a discharge chamber defined therein, an inlet port and an outlet port provided in an outer surface of said housing, and a discharge path connecting the discharge chamber and the outlet port;

a compressing unit provided in said housing, said compressing unit comprising a movable scroll and a stationary scroll defining a compression chamber configured to compress a working fluid supplied to the intake chamber from the inlet port and discharging the compressed working fluid to the discharge chamber, the working fluid including lubricating oil, wherein the discharge chamber is formed between the stationary scroll and an end wall of the housing;

a separating device arranged in the discharge path and separating a part of the lubricating oil in the working fluid from the working fluid;

a connection passage disposed in the discharge path, said connection passage providing fluid communication between said separating device and the outlet port, wherein the separating device comprises:

a separating chamber formed in the end wall of the housing adjacent to the discharge chamber and forming an upstream portion of the discharge path;

a separating tube arranged in the separating chamber, wherein a lower end opens into the separating chamber and an upper end is connected to a downstream portion of the discharge path, and configured to cause the working fluid flowed into the separating chamber to swirl around the separating tube, whereby a part of the lubricating oil is separated from the working fluid;

an oil storage chamber formed between the stationary scroll and the end wall of the housing, such that the oil storage chamber is arranged in a lower side of the separating chamber and collects the separated lubricating oil from the separating chamber; and a return passage for returning the lubricating oil to the intake chamber from the oil storage chamber; and a relief device in fluid communication with said connection passage for ejecting the working fluid in the discharge path to an outer side of the discharge path when a pressure in the discharge path exceeds a predetermined relief pressure in a downstream position of said separating device, wherein the relief device comprises a relief valve located near the outlet port, and wherein the housing further comprises:

a bulge portion integrally protruding to an inner side of the discharge chamber from the end wall and extending in a vertical direction; and a cylindrical bore formed in the bulge portion, wherein the separating chamber is formed by a lower portion of the cylindrical bore, wherein said relief device is configured to reduce an amount of working fluid discharged when a pressure in the discharge path exceeds a predetermined relief pressure, and wherein the downstream portion of the discharge path is formed in the end wall of the housing, and includes the connection passage extending to the outlet port from an upper portion of the cylindrical bore, and wherein the connection passage has an axis orthogonal to an axis of the cylindrical bore.

2. The compressor according to claim 1, wherein said relief valve is located in an upper portion of said housing.

3. The compressor according to claim 1, wherein said housing further has an adapter pipe forming the outlet port, and said relief valve is located in said adapter pipe.

* * * * *